US005167670A

United States Patent [19]

Johnson

[11] Patent Number: 5,167,670

[45] Date of Patent: Dec. 1, 1992

[54] FUEL COMPOSITIONS

[75] Inventor: Thomas H. Johnson, Houston, Tex.

[73] Assignee: Shell Oil Company, Houston, Tex.

[21] Appl. No.: 762,991

[22] Filed: Sep. 20, 1991

[51] Int. Cl.[5] ..... C10L 1/22; C07C 125/06

[52] U.S. Cl. ..... 44/387; 44/403; 560/157; 560/158; 560/159

[58] Field of Search ..... 44/387; 560/157, 158, 560/159

[56] References Cited

U.S. PATENT DOCUMENTS

| | | | |
|---|---|---|---|
| 2,692,257 | 10/1954 | Zletz | 260/88.2 |
| 2,692,258 | 10/1954 | Roebuck | 260/88.1 |
| 2,692,259 | 10/1954 | Peters | 260/88.1 |
| 2,918,508 | 12/1959 | Coopersmith et al. | 260/683.15 |
| 2,970,179 | 1/1961 | Glaze, Jr. | 260/683.15 |
| 4,357,148 | 11/1982 | Graiff | 44/62 |
| 4,936,868 | 6/1990 | Johnson | 44/381 |
| 4,946,473 | 8/1990 | Johnson | 44/387 |
| 4,946,982 | 8/1990 | Johnson | 44/387 |

FOREIGN PATENT DOCUMENTS 8810250 12/1988 PCT Int'l Appl. .

*Primary Examiner*—Ellen McAvoy

[57] ABSTRACT

The present invention is directed to novel poly(olefin)-polyamine-N-substituted polycarbamates, useful for preventing or reducing deposits in engines having the formula I

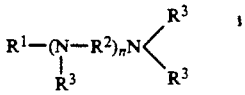

(I)

wherein "n" is 2–8; $R^1$ is a poly(olefin) chain having an average molecular weight of from about 500 to about 9900; $R^2$ is an alkylene group containing 2 to 8 carbon atoms; $R^3$ is independently a hydrogen atom, an alkyl group containing from 1 to 7 carbon atoms or —$COOR^5$ with at least two of $R^4$ being —$COOR^5$ and wherein $R^5$ is a hydrocarbyl or substituted hydrocarbyl group containing up to 20 carbon atoms.

3 Claims, No Drawings

FUEL COMPOSITIONS

BACKGROUND OF THE INVENTION

1. Field of the Invention

The present invention relates to novel poly(olefin)-polyamine-N-substituted-polycarbamates, their use in preventing deposit formation in engines and to fuel compositions containing these novel poly(olefin)-polyamine-N-substituted-polycarbamates.

2. Background

It is known that during the initial operation of a new or clean internal combustion engine, a gradual increase in octane requirement (OR), i.e., the fuel octane number required for knock-free operation, increases with the buildup of combustion chamber deposits until a stable level is reached which generally corresponds to a time when deposits remain relatively constant. The actual stable level can vary with engine design and even with individual engines of the same design.

Many additives are known which can be added to hydrocarbon fuels to attempt to prevent or reduce deposit formation or remove or modify formed deposits in the combustion chamber and adjacent surfaces, such as valves, ports, and spark plugs, in order to reduce octane requirement.

Continued improvement in design of internal combustion engines, e.g., fuel injection and the like, brings changes to the atmosphere of the combustion chamber so there is a continuing need for new additives to control the problem of deposits and improve drivability which is usually related to deposits.

Additive molecules that liberate carbon dioxide under thermal conditions have been found to aid in the control and/or removal of deposits. U.S. Pat. No. 4,936,868, issued Jun. 26, 1990, discloses the use of certain poly(olefin)-N-substituted-carbamates as a deposit preventing or reducing additive in gasolines. These additive molecules have one carbon dioxide producing carbamate group per molecule. To increase the carbon dioxide producing effect of this additive in a gasoline requires increasing the amount of additive present, which can result in undesired side effects.

OBJECTS OF THE INVENTION

It is an object of the invention to provide a gasoline additive having enhanced carbon dioxide liberating ability which thereby enhances its ability to reduce or prevent deposits in engines.

It is further an object of this invention to provide a gasoline composition, particularly an unleaded gasoline composition, which reduces intake valve deposits in electronic port fuel injected engines and the poor driveability which is characteristic of intake valve deposition in these engines and which is also compatible with carburetor and throttle body injected engines which are still in use.

SUMMARY OF THE INVENTION

The present invention is directed is directed to novel poly(olefin)-polyamine-N-substituted polycarbamates, useful for preventing or reducing deposits in engines of the formula I

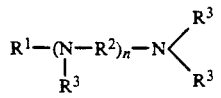

(I)

wherein "n" is 2–8, preferably 3–5; $R^1$ is a poly(olefin) chain having an average molecular weight of from about 500 to about 9900, preferably from about 550 to about 4900 and most preferably from about 600 to about 1300; $R^2$ is an alkylene group containing 2 to 8 carbon atoms, preferably 2 to 5 carbon atoms; $R^3$ is independently a hydrogen atom, an alkyl group containing from 1 to 7 carbon atoms and preferably methyl, ethyl or methyl plus ethyl, or —$COOR^5$ with at least two of $R^3$ being —$COOR^5$ and wherein $R^5$ is a hydrocarbyl or substituted hydrocarbyl group containing up to 20 carbon atoms, preferably alkyl of 1–10 carbons atoms and most preferably alkyl of 1–4 carbon atoms.

DESCRIPTION OF THE PREFERRED EMBODIMENTS

The novel poly(olefin)-N-substituted-carbamates of the invention are a new class of additives, useful for fuels, e.g., in the gasoline boiling range, for preventing deposits in engines while also readily breaking down cleanly producing very little residue and are miscible with carriers, such as polymeric olefins and the like. Spark plugs from some engines run on some of the fuels containing the novel poly(olefin)-N-substituted-carbamates of the invention are exceptionally clean.

Non-limiting illustrative embodiments of the invention include those of formula I wherein:

| $R^1$ | $R^2$ | $R^3$ | n |
|---|---|---|---|
| polyisobutylene | ethylene | tris-hydrogen + bis-methylcarboxyl | 3 |
| polyisobutylene | propylene | tris-methyl + tris-methylcarboxyl | 4 |
| polyisobutylene | isobutylene | bismethyl + tetra-isobutylcarboxyl | 4 |
| polyisobutylene | isobutylene | bismethyl + bis-isobutylcarboxyl + bis-methylcarboxyl | 4 |

The poly(olefin)carbamate compounds of formula I of the invention are conveniently prepared by treating a poly(olefin)-secondary-polyamine intermediate as described later with a compound of the formula II

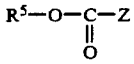

(II)

in which Z is a halogen, ether, or thioether group and $R^5$ has the above meaning. The hydrocarbyl and substituted hydrocarbyl groups of $R^5$ in formula II include aliphatic, alicyclic, aromatic or heterocyclic groups. The substituted hydrocarbyl groups include those hydrocarbyl groups substituted by non-interfering atoms or substituents including ring-O, ring-N, keto, nitro, cyano, alkoxy, acyl and the like. The compounds of formula II are generally available in the art. Suitably, such halides or esters of formula II include carbonates and thiocarbonates. Preferably, the compounds of formula II include those compounds wherein $R^5$ is an alkyl group containing from 1 to 10 carbon atoms, an alkenyl group containing from 2 to 7 carbon atoms, a cycloalkyl group containing from 3 to 7 ring carbon atoms and a total of 3 to 10 carbon atoms or an aryl, aralkyl or alkaryl group containing from 6 to 10 total carbon atoms. Preferably, $R^5$ is an alkyl group containing 1 to 4 carbon atoms, such as methyl, ethyl, n-propyl isopropyl, n-butyl, isobutyl or the like. Preferably, $R^5$ is methyl, ethyl, propyl, n-butyl or isobutyl. Z is preferably a halogen, such as chlorine.

At least two moles, more preferably at least three moles and most preferably at least four moles of compounds of formula II is used for each mole of poly(olefin)-secondary-polyamine intermediate. Two or more different compounds of formula II having different $R^5$ groups may be used in the reaction mixture to produce a product having different alkyl carbamate moieties on the nitrogen atoms. Alternatively, one compound of formula II is reacted with the polyamine intermediate under conditions to provide incomplete substitution of the nitrogen atoms with carbamate moieties, the subsequent product recovered and then the reaction cycle repeated with the product and a different compound of formula II to provide a product having different alkyl carbamate moieties on the nitrogen atoms.

The reaction to produce the compounds of formula I is usually conducted in a solvent which is non-reactive with chloroformates and which solubilizes the two reactants. Hydrocarbon solvents such as toluene, xylene or the like are suitable.

The reaction is conveniently conducted under relatively moderate conditions. The pressure is readily normal pressure and ambient temperatures of about 0° to about 40° C., e.g., room temperature, are convenient. Other moderate temperatures and pressures can be used which will not decompose the desired product.

The poly(olefin)carbamate product of formula I is recovered by conventional techniques, such as drying by stripping water or by using anhydrous sodium sulfate or the like.

The solvent is usually removed, e.g., by stripping, for neat analysis. However, for practical applications some or all of the solvent can be retained as a diluent.

Small amounts of poly(olefin)-secondary-unreacted amine intermediate need not be removed from the product as the presence thereof does not interfere with the usefulness of the product of formula I. Unreacted amine can aid in the effects of the poly(olefin)-polyamine-N-substituted-polycarbamates of the invention by acting as a carrier, assisting in enhancing the preventing, removing or retarding of engine deposits (particularly when the carbamate is of methyl or a non-beta hydrogen group) or by providing their known fuel detergents properties. Other known materials for use in fuels can also serve one or more of these purposes, including the polymer additives described later.

Poly(olefin)-secondary-polyamine Intermediates

The poly(olefin)-secondary-polyamine intermediates can be prepared by reacting olefinic polymers with amines employing conventional procedures as hereinafter described.

These oil soluble poly(olefin)-secondary polyamine intermediates have at least one polymer chain having a molecular weight in the range from about 500 to about 9,900 and preferably from about 550 to about 4,900, and particularly from 600 to 1,300, and which can be saturated or unsaturated and straight or branched chain and are attached to a nitrogen and/or a carbon atom of the amine.

Preferred poly(olefin)-N-substituted-secondary-amine intermediates are polyalkylene polyamines having the structural formula III

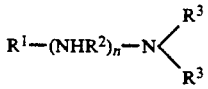

$$R^1-(NHR^2)_n-N\begin{matrix}R^3\\R^3\end{matrix} \quad \text{(III)}$$

wherein $R^1$ is selected from polyolefin having a molecular weight from about 500 to about 9,900, each $R^2$ is an alkylene radical having from 2 to 8 carbon atoms, preferably 2 to 5 carbon atoms, $R^3$ is independently a hydrogen atom or lower alkyl containing 1 to 7 carbon atoms and preferably is methyl, ethyl or methyl plus ethyl and "n" is 2 to 8. Preferred is a polyalkylene polyamine wherein $R^1$ is a branched-chain olefin polymer in the molecular weight range of 550 to 4,900, with a molecular weight range of 600–1300 being particularly preferred.

Olefin Polymers Reactants

The olefinic polymers ($R^1$ in formula I and III) which are reacted with amines to form the poly(olefin)-N-substituted-secondary-polyamine intermedates of the present invention are known in the art, such as U.S. Pat. No. 4,357,148, incorporated by reference herein, and include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substituted alkenyl and alkyl groups are polyethylene groups, polypropylene groups, polybutylene groups, polyisobutylene groups, polyethylene-polypropylene groups, polyethylene-polyalpha-methyl styrene groups and the corresponding groups without double bonds. Particularly preferred are polypropylene and polyisobutylene groups.

Amine Reactants

The polyamines used to react with the polyolefins to form the poly(olefin)-N-substituted-secondary-polyamine intermediates include aliphatic, alicyclic, aromatic or heterocyclic polyamines. A variety of such amines is well documented in the art including U.S. Pat. No. 4,191,537, incorporated by reference. The amines can contain other non-reactive substituents. Suitable substitutents for such amines include alkyls such as methyl, ethyl, propyl, butyl, isobutyl, pentyl, hexyl, octyl, and the like; alkenyls such as propenyl, isobutenyl, hexenyl, octenyl and the like; hydroxyalkyls, such as 2-hydroxyethyl, 3-hydroxypropyl, hydroxy-, isopropyl, 4-hydroxybutyl, etc.; alkoxy and lower alkenoxyalkyls, such as ethoxyethyl, ethoxypropyl, propoxyethyl, propoxypropyl, 2-(2-ethoxyethoxy)ethyl, and acyl groups such as propionyl, acetyl, and the like. Preferred substituents are $C_1$–$C_6$ alkyls.

Heterocyclic amines can be saturated, unsaturated and substituted or unsubstituted. Suitable heterocyclic amines include piperazines, such as 2-methylpiperazine, N-(2-hydroxyethyl)piperzaine, 1,2-bis-(N-piperazinyl)-ethane, and N,N'-bis(N-piperazinyl)piperazine, 2-methylimidazoline, and the like.

The amine reactants include mixtures of compounds, including isomers.

The polyamines used to form the preferred poly(olefin) polyamine intermediate compounds of this invention include low molecular weight aliphatic polyamines such as ethylene diamine, diethylene triamine, triethylene tetramine, tetraethylene pentamine, tripropylene tetramine, pentapropylene hexamine, triisobutylene tetraamine, tetraisobutylene pentaamine, triisoamylene tetramine, tetraisoamylene pentamine, pentaisoamylene hexamine and higher homologues up to about 35 carbon atoms.

Compounds possessing triamine as well as tetramine and pentamine groups are preferred for use because these can be prepared from technical mixtures of polyethylene polyamines, which offer economic advantages.

The polyamine starting materials from which the polyamine groups can be derived can also be a cyclic polyamine, for instance, the cyclic polyamines formed when aliphatic polyamines with nitrogen atoms separated by ethylene groups were heated in the presence of hydrogen chloride.

An example of a suitable process for the preparation of the poly(olefin)-polyamine compounds employed according to the invention is the reaction of a halogenated hydrocarbon having at least one halogen atom as a substituent and a hydrocarbon chain as defined hereinbefore with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at elevated temperature in the presence of a solvent; particularly a solvent having a boiling point of at least 160° C.

Fuel Compositions

Suitable liquid hydrocarbon fuels of the gasoline boiling range are mixtures of hydrocarbons having a boiling range of from about 25° C. (77° F.) to about 232° C. (450° F.), and comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer and trimerized olefins, synthetically produced aromatic hydrocarbon mixtures, from thermally or catalytically reformed hydrocarbons, or from catalytically cracked or thermally cracked petroleum stocks, and mixtures of these. The hydrocarbon composition and octane level of the base fuel are not critical. The octane level, $(R+M)/2$, will generally be above 85. Any conventional motor fuel base can be employed in the practice of this invention. For example, in the gasoline, hydrocarbons can be replaced by up to substantial amounts of conventional alcohols, or ethers, conventionally known for use in fuels. The base fuels are desirably free of water, since water could impede a smooth combustion.

Normally, the hydrocarbon fuel mixtures to which the invention is applied are substantially lead-free, but may contain minor amounts of blending agents such as methanol, ethanol, ethyl tertiary butyl ether and the like, at from about 0.1 to about 15% volume of the base fuel. The fuels can also contain antioxidants such as phenolics, e.g., 2,6-di-tert-butyl-phenol or phenylenediamines, e.g., N,N'-di-sec-butyl-p-phenylenediamine, dyes, metal deactivators, dehazers such as polyester-type ethoxylated alkylphenol-formaldehyde resins and the like. Corrosions inhibitors, such as a polyhydric alcohol ester of a succinic acid derivative having on at least one of its alpha-carbon atoms an unsubstituted or substituted aliphatic hydrocarbon group having 20 to 500 carbon atoms, for example, pentaerythritol diester of polyisobytylene-substituted succinic acid, the polyisobytylene group having an average molecular weight of about 950, in an amount of about 1 to 1000 ppmw. The fuels can also contain antiknock compounds such as methyl cyclopentadienylmanganese tricarbonyl, orthoazidophenol and the like as well as co-antiknock compounds such as benzoyl acetone.

An effective amount poly(olefin)-N-substituted polycarbamates of the present invention can be introduced into the combustion zone of the engine in a variety of ways to prevent buildup of deposits, or to accomplish reduction or modification of deposits. Thus, the poly(olefin)polyaminepolycarbamates can be injected into the intake manifold intermittently or substantially continuously, as described, preferably in a hydrocarbon carrier having a final boiling point (by ASTM D86) lower than about 232° C. (450° F.). A preferred method is to add the agent to the fuel. For example, the agent can be added separately to the fuel or blended with other fuel additives. The effective amount of poly(olefin)-polyamine-N-substituted polycarbamates of the invention used will of course depend on the particular compound(s) used, the engine and the fuel and carrier types. For example, the poly(olefin)-polyamine-N-substituted polycarbamates can be used in an amount of from about 20 to about 1000, preferably from about 50 to about 750, and most preferably from about 100 to about 500 ppm weight based on the total weight of the fuel composition.

For use in the fuel compositions of the invention, mixtures of different poly(olefin)-polyamine-N-substituted-polycarbamates can be used. For example, a mixture where $R^5$ of formula I is methyl and is isobutyl.

The poly(olefin)-polyamine-N-substituted polycarbamate of the invention can also be used in combination with certain polymeric components which are polymers of monoolefins having up to 6 carbon atoms; poly (oxyalkylene) alcohols, glycols or polyols; or polyolefin amines. Such materials are well known in the art. For example, polymers of monoolefins are including U.S. Pat. Nos. 2,692,257, 2,692,258, 2,692,259, 2,918,508, and 2,970,179 and their disclosures are incorporated herein by references.

Such polymers include (1) polymers of $C_2$ to $C_6$ monoolefins, (2) copolymers of $C_2$ to $C_6$ monoolefins, (3) the corresponding hydrogenated polymer (1) or copolymer (2) or (4) mixtures of at least two of (1), (2), (3) and (4), and polymeric component having an average molecular weight by osmometry in the range of from about 500 to about 3500, preferably about 500 to about 1500. Particularly preferred are those having said average molecular weight in the range from about 600 to about 950. Mixtures of polymers wherein a substantial portion of the mixture has a molecular weight above 1500 are considerably less effective. The polyolefins may be prepared from unsaturated hydrocarbons having from 2 to 6 carbon atoms including, e.g., ethylene, propylene, butylene, isobutylene, butadiene, amylene, isoprene, and hexene.

Preferred for their efficiency and commercial availability are polymers of propylene and butylene; particularly preferred are polymers of polyisobutylene. Also suitable and part of this invention are derivatives resulting after hydrogenation of the above polymers.

Poly(-$C_2$ to $C_6$-oxyalkylene) alcohols, glycols and polyol carriers can be used singly or in mixtures, such as the Pluronics marketed by BASF Wyandotte Corp., and the UCON LB-series fluids marketed by Union Carbide Corp. Preferably, these carriers include poly(oxypropylene) alcohol, glycol or polyol of molecular weight of about 300 to about 4000, which may or may not be capped by an alkyl group, e.g., a ($C_{1-10}$ hydrocarbyl)poly(oxypropylene) alcohol and polyethylene glycols of molecular weight of from about 300 to 4000.

The poly(olefin) amines of a $C_2$ to $C_6$ monoolefin, described hereinbefore for use as the starting materials used to make the compounds of formula I are also useful as the poly(olefin) amine fuel additives.

The invention further provides a concentrate for use in liquid (hydrocarbon) fuel in the gasoline boiling range comprising (a) from about 25 to about 500 ppm by weight (preferred from about 50 to about 200 ppm) of the hereinabove described poly(olefin)-polyamine-N-substituted polycarbamate of the invention; (b) at least one from about 10 to about 1000 ppm (preferrably 50–400 ppm) by weight of a polymeric component which is (i) a polymer of a $C_2$ to $C_6$ monoolefin, (ii) a copolymer of a $C_2$ to $C_6$ monoolefin, (iii) the corresponding hydrogenated polymer or copolymer, (iv) a poly(oxy-$C_2$ to $C_6$-alkylene) alcohol, glycol or polyol, (v) a poly(olefin)amine of a $C_2$ to $C_6$ monolefin or mixtures of at least two of (i), (ii), (iii) (iv) and (v), (c) optionally from about 0 to about 20 ppm by weight of a dehazer and (d) balance a diluent, boiling in the range from about 50° C. (122° F.) to about 232° C. (450° F.). Very suitable diluents include oxygen-containing hydrocarbons and non-oxygen-containing hydrocarbons. Suitable oxygen-containing hydrocarbon solvents include, e.g., methanol, ethanol, propanol, methyl tert-butyl ether and ethylene glycol monobutyl ether. The solvent can be an alkane such as heptane, but preferably is an aromatic hydrocarbon solvent such as toluene, xylene alone or in admixture with said oxygen-containing hydrocarbon solvents. Optionally, the concentrate can contain from about 0 to about 20 ppm by weight of a dehazer, particularly a polyester-type ethoxylated alkylphenol-formaldehyde resin, or other conventional dehazer.

The invention further provides a method for operating a spark ignition internal combustion engine (ICE) which comprises introducing with the combustion intake fuel charge to said engine a deposit preventing or reducing effective amount of at least one poly(olefin)-polyamine-N-substituted polycarbamate of formula I. The invention is particularly suited for use in operating a port fuel injected engine on unleaded fuel and is compatible with carburetor and throttle body injected engines.

The preferences expressed earlier with regard to (a) the poly(olefin)-polyamine-N-substituted polycarbamates of formula I and/or (b) the polymeric component or other additives also apply to the concentrate, motor fuel composition and method of operating the ICE.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

ILLUSTRATIVE EMBODIMENTS

Example 1

Preparation of a Compound of Formula I with the following:

a) n being 4;
b) two $R^3$s being hydrogen;
c) four $R^3$s being —$COOR^5$;
d) all of the $R^5$s being isobutyl; and
e) $R^1$ being polyisobutlyene of 950 average molecular weight.

The above compound is hereinafter referred to as Isobutyl(4)PIB-TEPA-CARB, PIB referring to polyisobutylene, TEPA referring to tetraethylene pentamine and CARB referring to carbamate or carboxyl.

300 Grams of polyisobutylene-$(NHCH_2CH_2)_4$—$NH_2$ and 76 grams of toluene were charged to a 1000 ml, round-bottomed flask equipped with an air-driven stirrer, reflux condenser, thermometer, and addition funnel. To the addition funnel were added 153 grams of i-butyl chloroformate and 59 grams of toluene. The toluene solution was added dropwise at room temperature to the round-bottomed flash with stirring. The addition took about 50 minutes with an increase of 40° C. in reaction temperature. The reaction flask was heated to reflux after the addition was completed and maintained at that temperature for 4 hours. The reaction temperature was dropped to 40° C. The addition funnel was removed and replaced with a powder funnel. Through this latter funnel was added a solution of 121 grams of sodium carbonate in 484 grams of water. Upon completion of the addition, the flask was heated to reflux for 6 hours.

The contents of the reaction flask were transferred to a 2000 ml separatory funnel where the layers were separated and the lower water layer was removed. The remaining layer was treated with 250 ml of water until the water layer gave a neutral pH. The water was removed and the contents of the funnel were transferred to a 2000 ml Erlenmeyer flask. 250 Milliliters of toluene and about 5 grams of anhydrous sodium sulfate were added to the flask. After 4 hours of stirring, the contents of the Erlenmeyer flask were filtered and solvent removed by rotary evaporation. Evaluation of the neat material revealed a basic nitrogen content of 0.73% w and a total nitrogen of 2.97% w confirming that 3.8 or approximately four of the five nitrogens had reacted and were now rendered non-basic. Examination by IR showed a typical carbamate absorption at 1700 $cm^{-1}$ (uncorrected).

Example 2

Preparation of a Compound of Formula I with the following:

a) n being 4;
b)* two $R^3$s being methyl or hydrogen;
c) four $R^3$s being —$COOR^5$;
d) two of the $R^5$s being isobutyl and two of the $R^5$s being methyl; and
e) $R^1$ being polyisobutylene of 950 average molecular weight.

*The use of methyl chloroformate results in about one out of about four or five of the hydrogens on the nitrogens of TEPA being replaced with methyl. Isobutyl chloroformate as used in Example 1 does not produce the same effect. weight.

The above compound is hereinafter referred to as Isobutyl(2)methyl(2)PIB-TEPA-CARB.

This compound was prepared in the same manner as example 1 except that 74 grams of i-butyl chloroformate and 58 grams of methyl chloroformate were reacted with the PIB-TEPA. Evaluation of the product revealed a basic nitrogen content of 0.7% w and a total nitrogen of 2.3% w confirming that 3.8 or approximately four of the five nitrogens had reacted and were now rendered non-basic. Examination by IR showed a typical carbamate absorption at 1700 $cm^{-1}$ (uncorrected).

Example 3

Preparation of a Compound of Formula I with the following:

a) n being 4;

b)* two $R^3$s being methyl or hydrogen;

c) three $R^o$s being —$COOR^5$;

d) all of the $R^5$s being methyl; and e) $R^1$ being polyisobutylene of 950 average molecular weight.

*The use of methyl chloroformate results in about one out of about four or five of the hydrogens on the nitrogens of TEPA being replaced with methyl. Isobutyl chloroformate as in Example 1 does not produce the same effect.

The above compound is hereinafter referred to as Methyl(3)PIB-TEPA-CARB.

This compound was prepared in the same manner as example 1 except that 103 grams of methyl chloroformate were reacted with the PIB-TEPA. Evaluation of the product revealed a basic nitrogen content of 1.01% w and a total nitrogen of 2.73% w confirming that 3.1 or approximately three of the five nitrogens had reacted and were now rendered non-basic.

Example 3

Engine Tests

Fuels with and without the additives of the instant invention were tested in a Ford 3.0 liter engine with Port Fuel Injection (PFI) for 100 hours to determine the effectiveness of the instant additives in reducing intake valve deposits.

The base fuel comprised premium unleaded gasoline. The poly(olefin)-polyamine-N-substituted-polycarbamates were those prepared in Examples 1, 2 and 3 above. The polycarbamates were used at a 200 ppm by weight level.

Each engine was in clean condition at the start of the test, i.e., oil and filters were changed and all deposits had been removed from the intake manifolds, intake ports, intake valves and combustion areas of the engine. In order to test for the accumulation of deposits in the engine during each test, the engines were operated on a cycle consisting of idle mode and cruising modes of 30, 35, 45, 55 and 65 miles an hour with accelerations and decelerations. The tests were conducted for 100 hours and the weight of the value deposits was measured. Results of these tests are set forth in Table 1 below.

TABLE 1

Comparison of Intake Valve Deposits for a Series of PIB-TEPA-polyCARBs

| Additive | Average Deposit Weight, mg |
|---|---|
| None | 362 |
| Isobutyl(4)PIB-TEPA-CARB | 317 |
| Isobutyl(2)methyl(2)PIB-TEPA-CARB | 166 |

TABLE 1-continued

Comparison of Intake Valve Deposits for a Series of PIB-TEPA-polyCARBs

| Additive | Average Deposit Weight, mg |
|---|---|
| Methyl(3)PIB-TEPA-CARB | 51 |

Results of these tests demonstrate that the poly(olefin)-N-substituted-carbamates of the invention are very useful in very significantly preventing the accumulation of deposits in the engines tested as compared to the effects of the base fuel as shown by the much lower average valve deposits.

What is claimed is:

1. A compound comprising a poly(olefin)-polyamine-N-substituted polycarbonate having the formula I

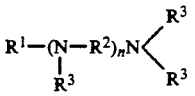

(I)

wherein "n" is 3–5, $R^1$ is a polyisobutylene chain having an average molecular weight of from about 600 to about 1300, $R^2$ is an alkylene group containing 2–5 carbon atoms, $R^3$ is selected from hydrogen, methyl, ethyl, and —COOR with at least three of $R^3$ being —$COOR^5$ and $R^5$ is an alkyl with 1 to 4 carbon atoms.

2. A motor fuel composition comprising a major amount of a hydrocarbon base fuel of the gasoline boiling range containing an effective amount to reduce intake valve deposits in electronic port fuel injected engines of a poly(olefin)-polyamine-N-substituted polycarbamate having the formula I

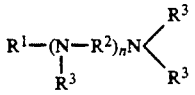

(I)

wherein "n" is 3–5, $R^1$ is a polyisobutylene chain having an average molecular weight of from about 600 to about 1300, $R^2$ is an alkylene group containing 2–5 carbon atoms, $R^3$ is selected from hydrogen, methyl, ethyl, and —$COOR^5$ with at least three of $R^3$ being —$COOR^5$, $R^5$ is an alkyl with 1 to 4 carbon atoms and the amount of poly(olefin)-polyamine-N-substituted polycarbamate ranges from about 100 to about 500 parts per million by weight based on the fuel composition.

3. A method for operating an electronic port fuel injected engine on an unleaded fuel composition compatible with carburetor and throttle body injected engines which comprises introducing into an electronic port fuel injected engine with the combustion intake charge an effective amount to reduce intake valve deposits of a poly(olefin)-polyamine-N-substituted polycarbamate having the formula I

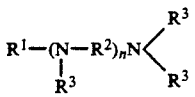

(I)

wherein "n" is 3–5, $R^1$ is a polyisobutylene chain having an average molecuar weight of from about 600 to about 1300, $R^2$ is an alkylene group containing 2–5 carbon atoms, $R^3$ is selected from hydrogen, methyl, ethyl and —$COOR^5$ with at least three of $R^3$ being —$COOR^5$, $R^5$ is an alkyl with 1 to 4 carbon atoms and the amount of poly(olefin)-polyamine-N-substituted polycarbamate ranges from about 100 to about 500 parts per million by weight based on the fuel composition.

* * * * *

UNITED STATES PATENT AND TRADEMARK OFFICE

CERTIFICATE OF CORRECTION

PATENT NO. : 5,167,670

DATED : Dec. 1, 1992

INVENTOR(S) : Thomas H. Johnson

It is certified that error appears in the above-identified patent and that said Letters Patent is hereby corrected as shown below:

In Column 10, claim 1 should read as follows:

1. A compound comprising a poly(olefin)-polyamine-N-substituted polycarbamate having the formula I

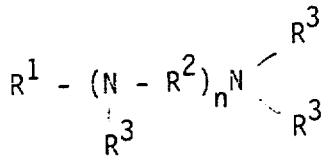

(I)

wherein "n" is 3-5, $R^1$ is a polyisobutylene chain having an average molecular weight of from about 600 to about 1300, $R^2$ is an alkylene group containing 2-5 carbon atoms, $R^3$ is selected from hydrogen, methyl, ethyl and $-COOR^5$ with at least three of $R^3$ being $-COOR^5$ and $R^5$ is an alkyl with 1 to 4 carbon atoms.

CERTIFICATE OF CORRECTION

PATENT NO. : 5,167,670

DATED : Dec. 1, 1992

INVENTOR(S) : Thomas H. Johnson

It is certified that error appears in the above-identified patent and that said Letters Patent are hereby corrected as shown below:

In Column 10, Claim 3 should read as follows:

3. A method for operating an electronic port fuel injected engine on an unleaded fuel composition compatible with carburetor and throttle body injected engines which comprises introducing into an electronic port fuel injected engine with the combustion intake charge an effective amount to reduce intake valve deposits of a poly(olefin)-polyamine-N-substituted polycarbamate having the formula I

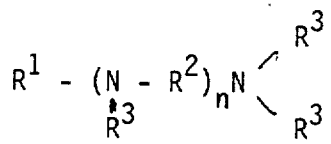

(I)

UNITED STATES PATENT AND TRADEMARK OFFICE

CERTIFICATE OF CORRECTION

PATENT NO. : 5,167,670

DATED : December 1, 1992

INVENTOR(S) : Thomas H. Johnson

It is certified that error appears in the above-indentified patent and that said Letters Patent is hereby corrected as shown below:

wherein "n" is 3-5, $R^1$ is a polyisobutylene chain having an average molecular weight of from about 600 to about 1300, $R^2$ is an alkylene group containing 2-5 carbon atoms, $R^3$ is selected from hydrogen, methyl, ethyl and $-COOR^5$ with at least three of $R^3$ being $-COOR^5$, $R^5$ is an alkyl with 1 to 4 carbon atoms and the amount of poly(olefin)-polyamine-N-substituted polycarbamate ranges from about 100 to about 500 parts per million by weight based on the fuel composition.

Signed and Sealed this

Seventh Day of November, 1995

*Attest:*

*Attesting Officer*

Bruce Lehman

BRUCE LEHMAN

*Commissioner of Patents and Trademarks*